US009906859B1

(12) United States Patent
Song et al.

(10) Patent No.: US 9,906,859 B1
(45) Date of Patent: Feb. 27, 2018

(54) NOISE ESTIMATION FOR DYNAMIC SOUND ADJUSTMENT

(71) Applicant: Bose Corporation, Framingham, MA (US)

(72) Inventors: Zukui Song, Wellesley, MA (US); Shiufun Cheung, Lexington, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/282,652

(22) Filed: Sep. 30, 2016

(51) Int. Cl.
*H04R 3/04* (2006.01)
*H04R 3/00* (2006.01)

(52) U.S. Cl.
CPC ..... *H04R 3/04* (2013.01); *H04R 3/005* (2013.01); *H04R 2430/03* (2013.01); *H04R 2499/13* (2013.01)

(58) Field of Classification Search
CPC ..... H04R 3/04; H04R 3/005; H04R 2430/03; H04R 2499/13
See application file for complete search history.

(56) References Cited

U.S. PATENT DOCUMENTS

| | | | | |
|---|---|---|---|---|
| 4,944,018 | A | 7/1990 | Bose et al. | |
| 5,034,984 | A | 7/1991 | Bose | |
| 5,434,922 | A | 7/1995 | Miller et al. | |
| 5,615,270 | A | 3/1997 | Miller et al. | |
| 8,903,722 | B2 * | 12/2014 | Jeub | H04R 3/005 704/226 |
| 9,245,519 | B2 * | 1/2016 | Klug | G10K 11/178 |
| 2013/0054231 | A1 | 2/2013 | Jeub et al. | |
| 2015/0281864 | A1 | 10/2015 | Song et al. | |
| 2017/0084288 | A1 * | 3/2017 | Chatlani | G10L 21/0216 |

FOREIGN PATENT DOCUMENTS

| | | | |
|---|---|---|---|
| CN | 105869651 | A | 8/2016 |
| EP | 1509065 | A1 | 2/2005 |
| EP | 1538867 | A1 | 6/2005 |

OTHER PUBLICATIONS

International Search Report & Written Opinion in International Patent Application No. PCT/US17/45827, dated Nov. 13, 2017; 16 pages.

Kaneda, Yutaka and Mikio Tohyama, "Noise Supression Signal Processing Using 2-Point Received Signals," Electronics and Communications in Japan, Dec. 1984, vol. 67-A, No. 12; 10 pages.

* cited by examiner

*Primary Examiner* — Brenda Bernardi
(74) *Attorney, Agent, or Firm* — Schmeiser, Olsen & Watts LLP

(57) ABSTRACT

A system that performs noise estimation for an audio adjustment application comprises a coherence calculator that determines at least one coherence value between microphone signals generated by at least two microphones that each independently senses acoustic energy in a listening space. A first microphone of the at least two microphones generates a first microphone signal from the acoustic energy and a second microphone of the at least two microphones generates a second microphone signal from the acoustic energy. The acoustic energy comprises a combination of an audio signal transduced by one or more speakers and environmental noise of the acoustic energy that is local to the listening space. A noise estimate computation processor determines an estimate of a level of the environmental noise based on the at least one coherence value.

22 Claims, 5 Drawing Sheets

NOISE ESTIMATION FOR DYNAMIC SOUND ADJUSTMENT

BACKGROUND

This description relates generally to dynamic sound adjustment, and more specifically, to noise estimation for dynamic sound adjustment, e.g., where sound is reproduced in a vehicle having an acoustic system.

BRIEF SUMMARY

In accordance with one aspect, a system that performs noise estimation for an audio adjustment application comprises a coherence calculator that determines at least one coherence value between microphone signals generated by at least two microphones that each independently senses acoustic energy in a listening space. A first microphone of the at least two microphones generates a first microphone signal from the acoustic energy and a second microphone of the at least two microphones generates a second microphone signal from the acoustic energy. The acoustic energy comprises a combination of an audio signal transduced by one or more speakers and environmental noise of the acoustic energy that is local to the listening space. A noise estimate computation processor determines an estimate of a level of the environmental noise based on the at least one coherence value.

Aspects may include one or more of the following features:

The estimate of the noise level may be determined in a high frequency band that is greater than 4 kHz. The high frequency band may be between 4.5 kHz and 6 kHz.

The listening space may comprise a vehicle cabin.

The coherence calculator may receive the first microphone signal generated in response to the acoustic energy detected by the first microphone at a first location in the vehicle cabin, and may receive the second microphone signal generated in response to the acoustic energy detected by the second microphone at a second location in the vehicle cabin.

The system may determine an amount of energy in the first and second microphone signals that is attributable to the noise. A coherence measurement corresponding to the at least one coherence value may be related to an energy level of the first and second microphone signals.

The system may further comprise a high frequency noise estimator that processes an output of the noise estimate computation processor to generate an adjustment value for adjusting the first and second audio signals to compensate for effects from the noise.

In accordance with another aspect, a noise compensation system, comprises a first input for receiving a first microphone signal; and a second input for receiving a second microphone signal. The first and second microphone signals generated from acoustic energy are detected by the first and second microphones. The acoustic energy represents a combination of an audio signal transduced by one or more speakers and environmental noise local to the first and second microphone signals. The system further comprises a first coherence calculator that determines a first coherence value from a comparison of a first frequency band of a plurality of frequencies of the first and second microphone signals; a second coherence calculator that determines a second coherence value from a comparison of a second frequency band of the plurality of frequencies of the first and second microphone signals; and a noise estimate computation processor that determines an estimate of a level of the noise in the acoustic energy in response to the first and second coherence values.

Aspects may include one or more of the following features:

The first and second frequency bands may be centered at a frequency greater than 4 kHz. The first and second frequency bands may be located between frequencies ranging from 4.5 kHz and 6 kHz.

The noise level of the first and second microphone signals may be derived from the environmental noise local to the first and second microphone signals, respectively.

The noise estimate computation processor may include a noise estimator that implements and may execute one or more noise estimation schemes that are used in combination to derive an estimate of the noise based on an approximation according to the first and second coherence values.

In another aspect, a dynamic audio adjustment system comprises a first filter that processes a first microphone signal input and outputs a predetermined range of frequencies of the first microphone signal input; and a second filter that processes a second microphone signal input and outputs a predetermined range of frequencies of the second microphone signal input. The first and second microphone signal inputs represent acoustic energy in a listening space that is sensed by a first microphone and a second microphone, respectively. The acoustic energy comprises a combination of an audio signal transduced by one or more speakers and noise within the listening space. A first frequency analyzer divides the predetermined range of frequencies of the first microphone signal input into a plurality of separate frequency bands, and outputs a frequency band value for each frequency band. A second frequency analyzer divides the predetermined range of frequencies of the second microphone signal input into a plurality of separate frequency bands, and outputs a frequency band value for each frequency band. A coherence calculator is for each frequency band, each coherence calculator determining a coherence value between frequency band values output from each of the first and second frequency analyzers. A noise estimate computation processor derives an estimate of a level of noise in the listening space based on an approximation according to the coherence values and generates an adjustment value from the estimate that adjusts the audio signal.

Aspects may include one or more of the following features:

The first and second frequency bands may be centered at a frequency greater than 4 kHz. The first and second frequency bands may be located between frequencies ranging from 4.5 kHz and 6 kHz.

The noise estimate computation processor may determine from the coherence values a coherence level relative to the microphone signals to derive the estimate of the level of noise.

The first microphone may be positioned at a first location in the listening space and the second microphone may be positioned at a second location in the listening space for sensing the acoustic energy.

The adjustment value may be output for adjusting different electrical audio signals input to multiple speakers.

The multiple speakers may include a first speaker receiving left channel audio content and a second speaker receiving right channel audio content.

In another aspect, a method for sound adjustment/noise compensation comprises processing, by a special-purpose dynamic audio adjustment computer, a first microphone signal from a first microphone; processing, by the special-purpose dynamic audio adjustment computer, a second microphone signal from a second microphone, the first and second microphone signals representing acoustic energy in a listening space that is sensed by the first microphone and the second microphone, respectively, the acoustic energy comprising a combination of an audio signal transduced by one or more speakers and noise within the listening space; performing by the special-purpose dynamic audio adjustment computer an approximation based on a coherence level between the first and second microphone signals; determining by the special-purpose dynamic audio adjustment computer an estimate of a level of the noise in the listening space based on the approximation; generating an adjustment value from the estimate; and adjusting the audio signal with the adjustment value.

In another aspect, a sound system, comprises a speaker that transduces an audio signal; a first microphone and a second microphone that each senses acoustic energy comprising the transduced audio signal and environmental noise and generates a corresponding microphone signal; and a dynamic audio adjustment system that performs a coherence processing technique on the first and second microphone signals and adjusts the audio signal in response to the coherence processing.

The dynamic audio adjustment system may include a noise estimator that implements and executes one or more noise estimation schemes that are used in combination to derive an estimate of a level of the environmental noise based on an approximation according to the coherence processing technique.

BRIEF DESCRIPTION

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Figure 1:
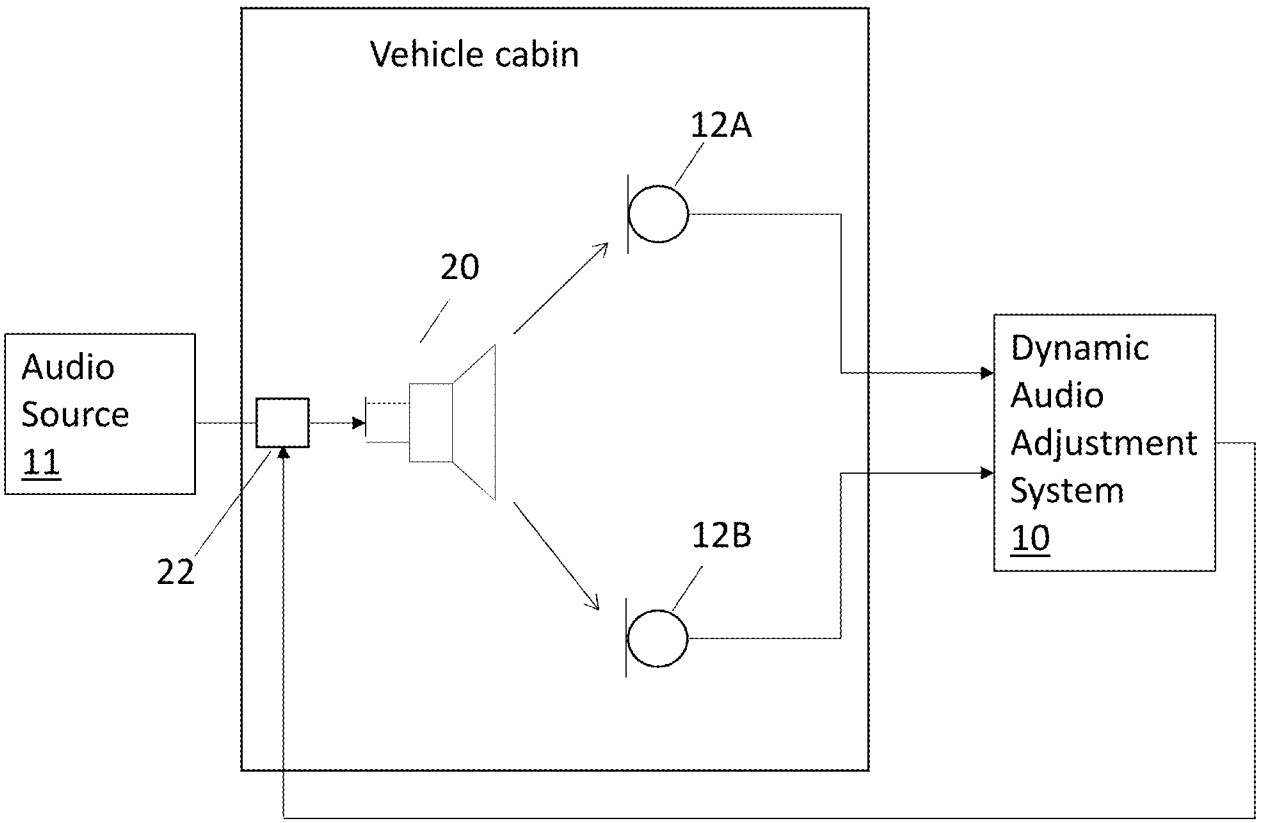
FIG. 1 is block diagram illustrating an environment in which examples of a dynamic audio adjustment system operate.

Modern audio reproduction systems installed in vehicles, which are capable of dynamic sound adjustment, may include noise detectors, such as a set of microphones positioned in the vehicle cabin that detects a combination of speaker output and surrounding noise (from a vehicle engine, wind, road noise, etc.), and may further include a processor that applies complex adaptive filtering to separate the noise from the current audio output from the speaker.

A limitation with this approach relates to the cost and feasibility of an acoustic system that is associated with how many audio channels its audio source includes, for example, mono, stereo, two channel, left/center/right (LCR), surround sound, and so on. For example, if the source provides a mono signal, then only one reference signal is present. This requires at least a single adaptive filter providing at least one transfer function logic for the single audio channel. However, if the source is stereo audio, then at least two adaptive filters are necessary for modeling at least two different transfer functions, because the left channel and the right channel take different paths to the microphone. Similarly, a 5.1 surround format requires six different channels, and therefore, at least six different adaptive filters, to separate the noise from the output audio at the microphones. In cases where an up-mixer is applied to the stereo input, the channel count can increase to a high number such as 32. Such an acoustic system may become more expensive due to the added complexity of multiple adaptive filters.

Another limitation pertains to multichannel adaptive filtering, where if the left channel and the right channel are highly correlated, then it is difficult for the left channel adaptive filter and the right channel adaptive filter to converge to the true transfer functions. For example, the similarity in the left and right channel reference signals may cause the adaptive filters to model similar transfer functions, even though the left and right channel transmission paths are clearly distinct from each other. The addition of more channels will only magnify this problem, possibly to the point that the adaptive filters will never converge to the correct transfer functions.

Another limitation pertains to acoustic systems that perform non-linear processing. Examples of non-linear processing include limiters, soft clippers, and the aforementioned up-mixers, which may include features such as compressed audio enhancement (CAE). Non-linear processing is not amenable to modeling by adaptive filters. Therefore, the presence of non-linear processing in the acoustic system renders the use of adaptive filtering in noise estimation difficult and expensive to perform.

In brief overview, examples of the present inventive concepts include the determining and processing of coherence between two microphones for high-frequency noise estimation, thereby reducing cost and complexity associated with the use of adaptive filtering in noise estimation. A system in these examples can process additional varieties of input sources such as 5.1-channel surround sound, since the abovementioned coherence processing is performed on the microphone signals who are sensing the output of the system. Accordingly, there is no need for scaling to accommodate the number of channels in the input source. Also, the system will not fail in the presence of non-linear signals in the audio system.

FIG. 1 shows a block diagram of an example dynamic audio adjustment system 10 installed in a vehicle (only a vehicle cabin is shown). Although an application of the system 10 in a vehicle is described, in other examples, the dynamic audio adjustment system 10 may be applied in any environment where the presence of noise may degrade the quality of sound reproduced by an audio system.

The dynamic audio adjustment system 10 is configured to compensate for effects of variable noise on a vehicle occupant's listening experience by automatically and dynamically adjusting the music, speech, or other sounds generated by an audio source 11 of an audio system as electrical audio signals, which are presented as sound by a speaker 20 so that users within earshot of the speaker 20, for example, occupants of a vehicle, can hear the sound produced by the speaker 20 in response to the received electrical audio signals. Although a single speaker 20 is shown and described in FIG. 1, some examples may include a plurality of speakers, each of which may present different audio signals. For example, one speaker may receive left channel audio data content and another may receive right channel audio data content.

The dynamic audio adjustment system 10 may be part of an audio control system. Other elements of the audio control system may include an audio source 11, for example, an acoustic system that plays music, speech, or other sound signals, one or more speakers 20, and one or more noise detectors, such as microphones 12A and 12B. The audio control system may be configured for mono, stereo, two channel, left/center/right (LCR), N:1 surround sound (where N is an integer greater than 1), or other multi-channel configuration.

The microphones 12 may be placed at a location near a listener's ears, e.g., along a headliner of the vehicle cabin. For example, the first microphone 12A may be at a first location in a vehicle cabin, for example, near a right ear of a driver or passenger, and the second microphone 12B may be at a second location in the vehicle cabin, for example, near a left ear of the driver or passenger. Each of the first microphone 12A and the second microphone 12B generates a microphone signal input in response to a detected audio signal. A detected audio signal received by the first microphone 12A may represent a combination of a common source of audio from the speaker (which is also detected by the second microphone 12B) and a source of noise from an environment (also referred to as environmental noise) within a range of detection of the first microphone 12A. For example, random sources outside or inside the vehicle cabin may contribute to the noise that is picked up by the first microphone 12A in addition to the audio output from the speaker 20. Similarly, a detected audio signal received by the second microphone 12B may represent a combination of the source of audio from the speaker (which is also detected by the first microphone 12A) and a source of noise from an environment within a range of detection of the second microphone 12B.

In brief overview, the dynamic audio adjustment system 10 separates the undesirable noise from the entertainment audio provided by the audio source 11. To do so, the dynamic audio adjustment system 10 performs a coherence processing technique on the first and second microphone signals, and processes the results to derive a noise estimate, which is then used to adjust an electrical audio signal input to the speaker 20. It is well-known that coherence is related to energy. Therefore, the system 10 can determine how much of the energy in a microphone signal is attributable to noise, since coherence is related to the energy level of the signal or the noise at the microphone.

The two microphones 12A, 12B, when listening to the same audio output from a speaker 20, are expected to receive highly correlated audio signals. However, noise from random sources such as wind or rain on the vehicle's windows, squealing brakes, or other high frequency sound sources, and/or from inside the vehicle may generate uncorrelated audio signals at the microphones 12A, 12B. By determining the coherence between the microphones 12A, 12B, the dynamic audio adjustment system 10 may derive an estimate of the noise level, which is then used to adjust the sound output from the vehicle's audio speakers.

Figure 2:
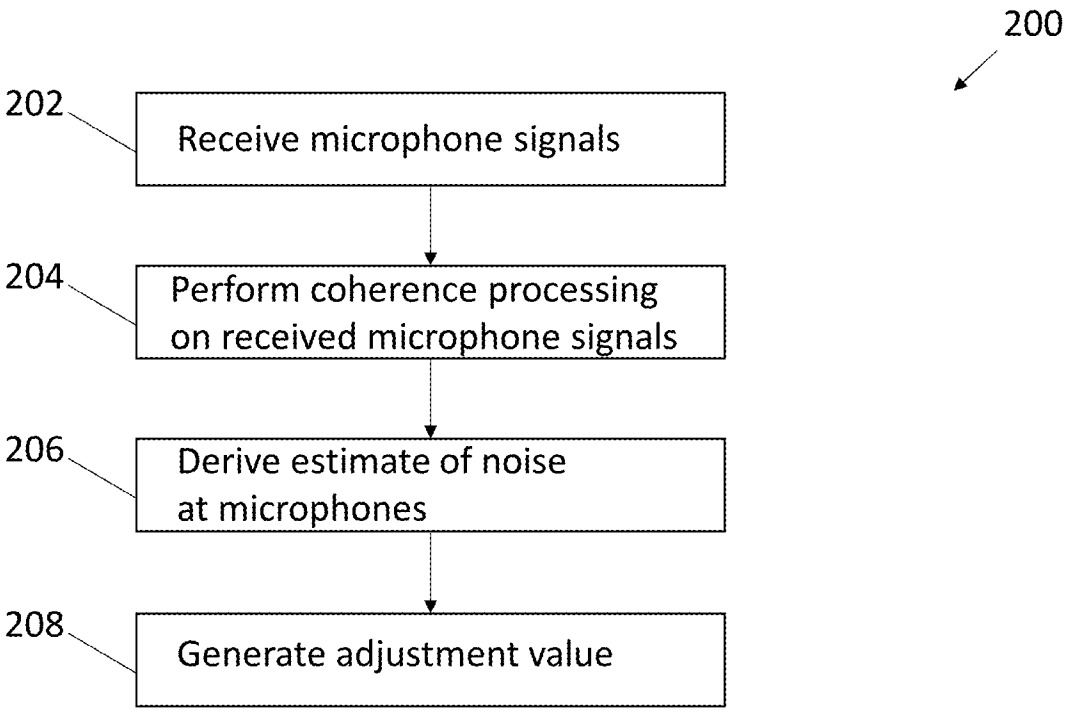
FIG. 2 is a flowchart of an example process performed by a dynamic audio adjustment system.

FIG. 2 is a flowchart of an example process 200 performed by a dynamic audio adjustment system. For example, the dynamic audio adjustment system 10 of FIG. 1 can apply the example process 200 to electrical audio signals input to a speaker 20 in real time in response to noise changes detected in a vehicle cabin.

According to process 200, two or more detectors, for example, microphones 12A and 12B, may detect a combination of acoustic energy output from the speaker 20 and environmental noise, for example, engine noise, wind, rain, or other high frequency noise sources, collectively referred to as an acoustic signal. The acoustic signal is detected by the microphones 12A and 12B, which each transfers the received combined acoustic signal to the adjustment system as an electronic microphone signal.

At block 202, the dynamic audio adjustment system 10 receives a first microphone signal from the first microphone 12A and a second microphone signal from the second microphone 12B.

Figure 5:
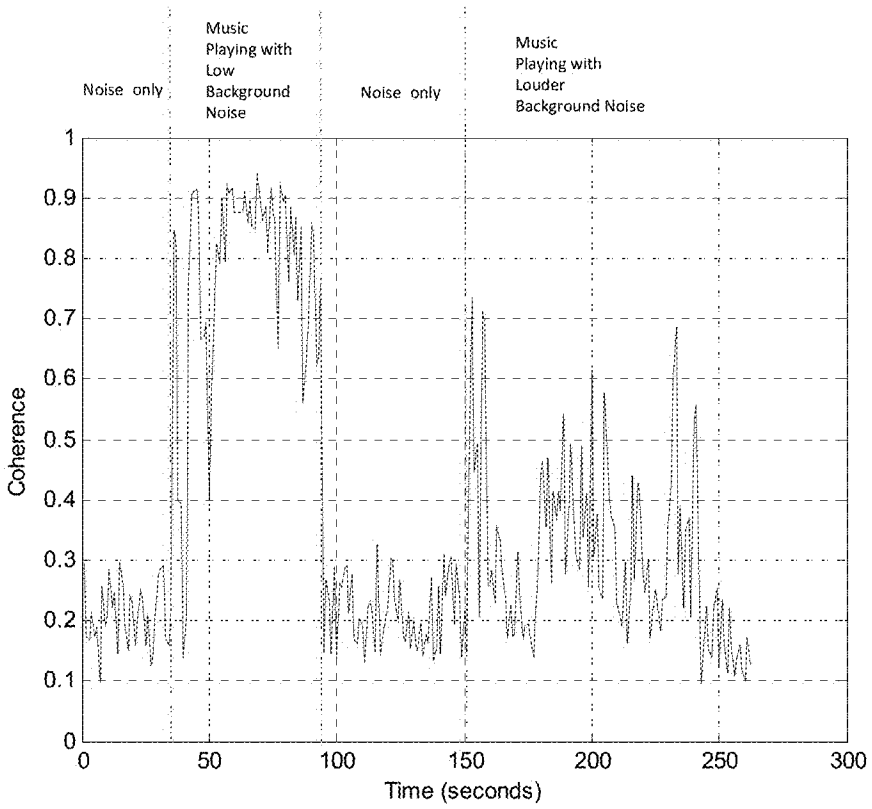
FIG. 5 is a graph illustrating a feature of an example of a dynamic sound adjustment system.

At block 204, the dynamic audio adjustment system 10 performs coherence processing on the first and second microphone signals received from the first microphone 12A and second microphone 12B, respectively. In particular, the dynamic audio adjustment system 10 performs an approximation based on a coherence level between the first and second microphone signals. In theory, the first and second microphone signals are correlated in the absence of high frequency noise, since the microphones 12A, 12B detect a common source of audio, i.e., entertainment audio output from the speaker 20. However, when the vehicle's windows are rolled down, wind, rain, and related noise may result in a drop in coherence between the first and second microphone signals, as the microphone signals may become more uncorrelated. In particular, a lack of correlation between the signals is indicative of the level of noise in the listening space. Coherence values, also referred to as coherence processing results, ranging from 0 to 1, may be derived using coherence processing. A coherence value, or the coherence between microphones 12A and 12B, of "0" may refer to an approximation that everything detected by the microphones 12A and 12B is noise-related. A coherence value of "1" may refer to an approximation that there is no noise present at microphones 12A and 12B. The coherence values of 0 and 1 can serve as the two boundaries, or points. Any point on the curve between the two points of 0 and 1 can be used to calculate a noise estimate (step 206). For example, a determined coherence value of 0.3 can be used to determine a noise estimate, for example, according to the following equation:

Noise level=microphone energy*$y0$, where $y0$ is a multiplicative factor that may be derived using a pre-determined function of the coherence value FIG. 5 illustrates coherence values related to various detected microphone signals.

At step 208, an adjustment value is generated by the dynamic audio adjustment system. The adjustment value is partially derived from the noise estimate calculated at step 206. Examples of other factors on which the adjustment value may be based include information from other noise detectors, and the energy level of the audio signal output. The adjustment value may be input to an audio processor 22 which combines the adjustment value with the electrical audio signal output from the audio source 11 to the speaker 20. The adjustment value adjusts the electrical audio signal input to the speaker 20 as a result of the coherence processing performed at step 204.

Figure 3:
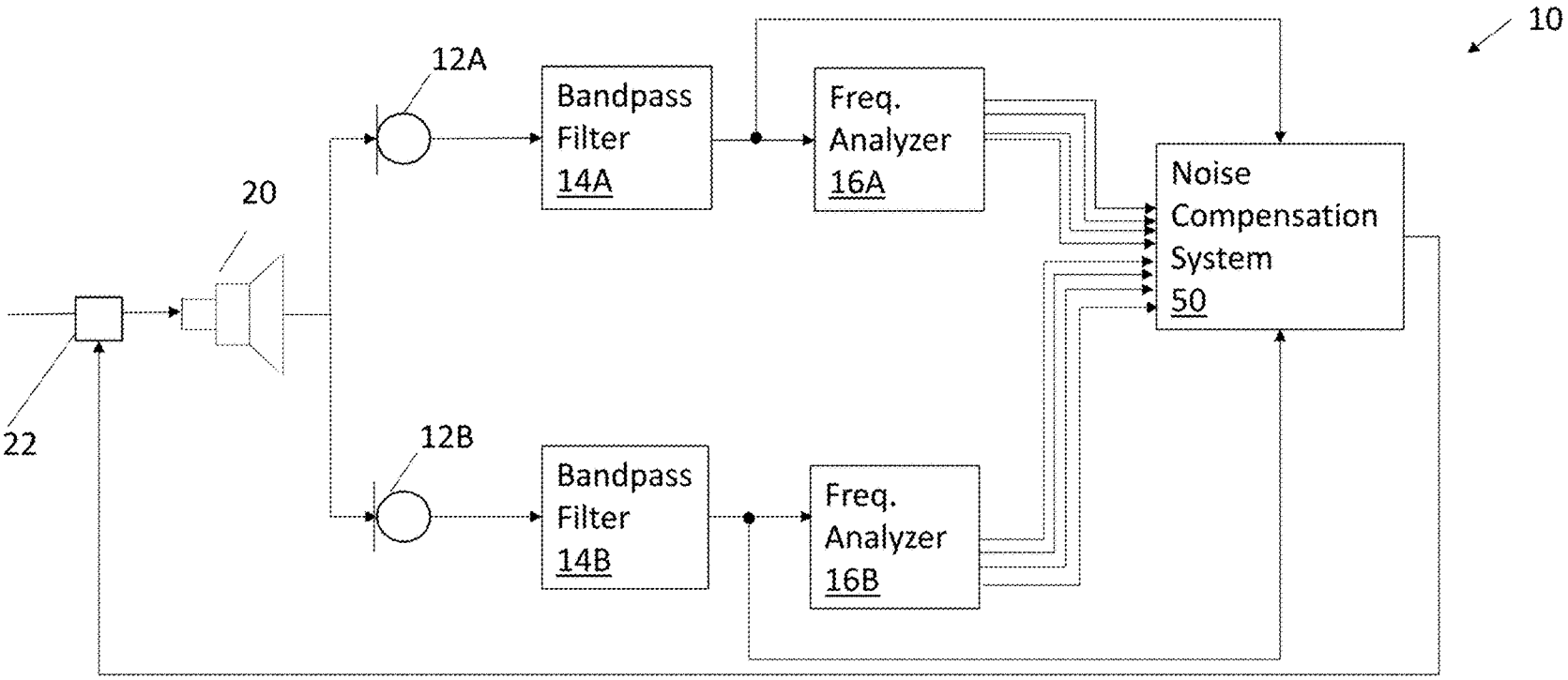
FIG. 3 is a block diagram of an example of a dynamic audio adjustment system.

As shown in FIG. 3, an example of a dynamic audio adjustment system 10 comprises a plurality of filters 14A, 14B (generally, 14), a plurality of frequency analyzers 16A, 16B (generally, 16), and a noise compensation system 50. In some examples, the microphones 12 and speaker 20 are part of the system 10. In other examples, the microphones 12 and speaker 20 exchange electronic signals with the dynamic audio adjustment system 10 via inputs and outputs of the dynamic audio adjustment system 10.

First filter 14A processes a microphone signal received from a first microphone 12A. Second filter 14B likewise processes a microphone signal received from a second microphone 12B. In some examples, more than two microphones 12 may be deployed in a vehicle cabin.

Each microphone 12A and 12B (generally, 12) independently listens to a common source of audio, and generates a microphone signal in response to a received audio signal that represents combination of a common source of audio from the speaker 20 and environmental noise local to the respective microphone 12.

One filter 14 is provided for each microphone 12. Microphone signals output to filters 14A and 14B, respectively, may be different due to differences in noise detected at each microphone 12A, 12B.

Each filter 14 serves to isolate from the input audio signals of the microphone signal from each microphone 12 in a predetermined and specific frequency band, for example a band that is located between frequencies ranging from 4.5 kHz and 6 kHz, but not limited thereto. Each filter 14 therefore outputs a predetermined range of frequencies of the corresponding received microphone signal input.

A first frequency analyzer 16A divides the range of frequencies, e.g., a frequency band between 4.5 kHz and 6 kHz, of the microphone signal output from the first filter 14A into a plurality of frequency bands. Similarly, a second frequency analyzer 16B divides the range of frequencies, e.g., a frequency band between 4.5 kHz and 6 kHz, of the microphone signal output from the second filter 14B into a plurality of frequency bands. The frequency analyzers 16 are therefore configured to isolate components at the same frequency from each microphone signal for comparison using coherence processing.

The noise compensation system 50 computes a separate coherence value between the microphone signals 12A and 12B for each corresponding frequency band. These values are then aggregated and used to determine an approximation factor. The relationship between the aggregate coherence value and the factor can be established by a predefined curve or a lookup table. This factor is then multiplied to the total energy of the signals output from filter 14A and 14B directly to the noise compensation system 50 to derive the noise level. Based on the results of that processing, the established noise level estimates may be used to generate the adjustment values, which may be output to an audio processor 22 which combines the adjustment values with electrical audio signals output from the audio source 11 to the speaker 20.

Figure 4:
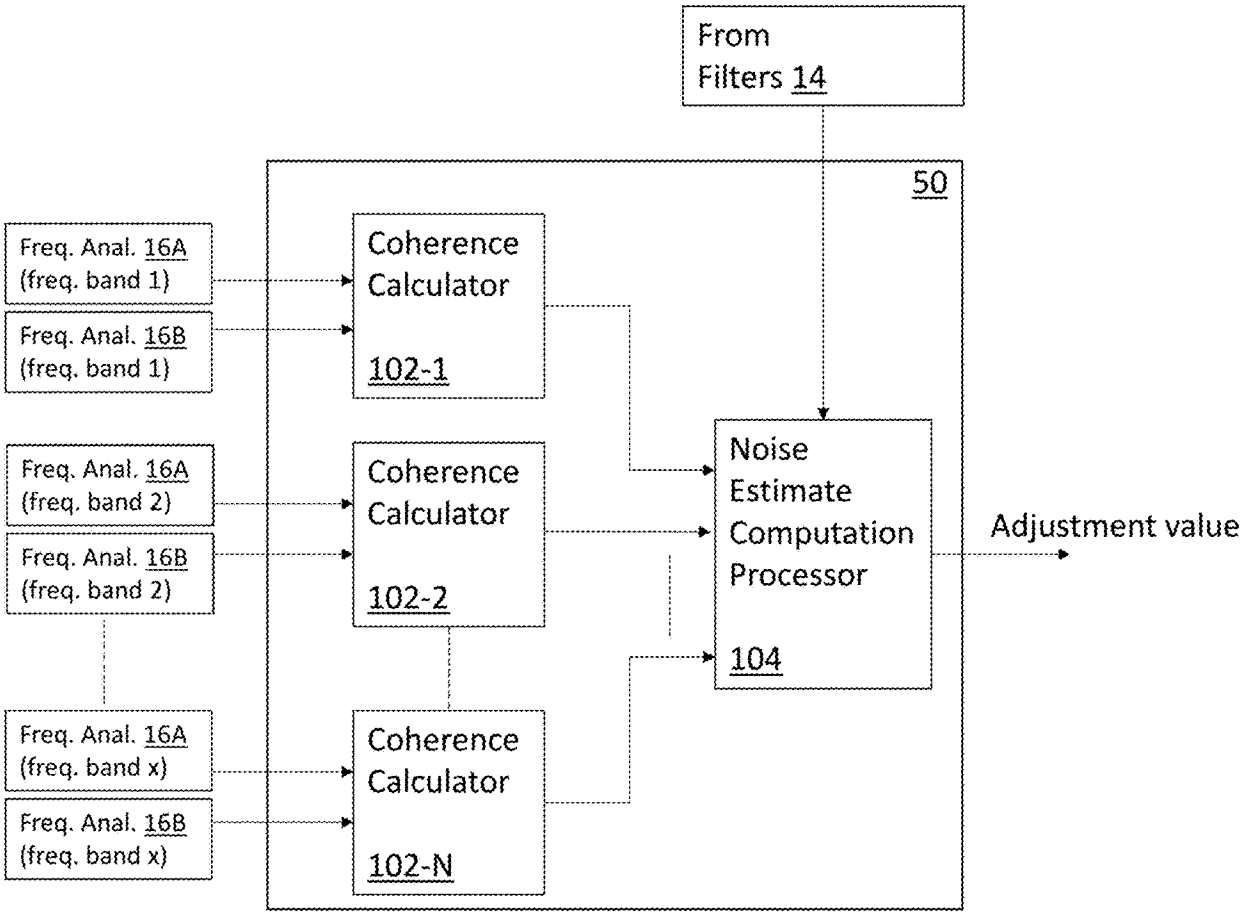
FIG. 4 is a block diagram of an example of a noise compensation system of the dynamic audio adjustment system of FIG. 3.

In some examples, also referring to FIG. 4, the noise compensation system 50 may comprise a plurality of coherence calculators 102-1 through 102-N, wherein N is an integer greater than 0, and a noise estimate computation processor 104. Each coherence calculator 102-1 to 102-N (generally, 102) includes two inputs, each communicating with a frequency analyzer 16A and 16B, and each receiving a frequency band ((1−x), where x=N or another integer greater than 0). Thus, each coherence calculator 102 receives an output from each frequency analyzer 16A and 16B. For example, coherence calculator 102-1 may receive a first frequency band (freq. band 1), e.g. 4.0-4.1 kHz, from first frequency analyzer 16A that includes a microphone signal from the first microphone 12A, and also receive the first frequency band (freq. band 1), e.g. 4.0-4.1 kHz, from second frequency analyzer 16B that includes a microphone signal from the first microphone 12B. Also in this example, coherence calculator 102-2 may receive a second frequency band (freq. band 2), e.g. 4.1-4.2 kHz, from first frequency analyzer 16A that includes a microphone signal from the first microphone, and also receive the second frequency band (freq. band 2), e.g. 4.0-4.1 kHz, from second frequency analyzer 16B that includes a microphone signal from the first microphone 12B.

Each coherence calculator 102-1 to 102-N (generally, 102) generates a coherence value in response to a comparison of a frequency band of the microphone signals output from the first and second frequency analyzers 16A and 16B, respectively. As described above, the microphone signals are generated in response to a received audio signal that represents a combination of a common source of audio from the speaker 20 and environmental noise local to the respective microphone 12A, 12B. Thus, the computed coherence results apply to a particular frequency range of the entire audio that may be heard by a listener, including noise and desirable audio. Also, the coherence at different frequency bands may vary, for example, higher coherence, or more correlation, between microphone signals at the various frequency bands for entertainment audio, lower coherence, or less correlation, between microphone signals at the various frequency bands for wind or road noise.

The noise estimate computation processor 104 may include a noise estimator that implements and executes one or more noise estimation schemes that are used in combination to derive an estimate of the noise based on an approximation according to the coherence values generated by the coherence calculators 102. Examples of such noise estimation schemes include the aforementioned noise estimation using adaptive filtering, as well as noise level derivation based on vehicle speed. An approximation value based on the noise level estimate is generated, and output to the audio processor 22 for adjusting an audio input to the speaker 20 to compensate for the noise detected by the microphones 12.

A number of implementations have been described. Nevertheless, it will be understood that the foregoing description is intended to illustrate and not to limit the scope of the inventive concepts which are defined by the scope of the claims. Other examples are within the scope of the following claims.

What is claimed is:

1. A system that performs noise estimation for an audio adjustment application, comprising:

a coherence calculator that determines at least one coherence value between microphone signals for each of a plurality of frequency bands generated by at least two microphones that each independently senses acoustic energy in a listening space, wherein a first microphone of the at least two microphones generates a first microphone signal from the acoustic energy and a second microphone of the at least two microphones generates a second microphone signal from the acoustic energy, wherein the acoustic energy comprises a combination of an audio signal transduced by one or more speakers and environmental noise of the acoustic energy that is local to the listening space; and a noise estimate computation processor that determines an estimate of a level of the environmental noise in the acoustic energy based on an approximation according to the at least one coherence value and generates an adjustment value from the estimate that adjusts the audio signal.

2. The system of claim 1, wherein the estimate of the noise level is determined in a high frequency band that is greater than 4 kHz.

3. The system of claim 2, wherein the high frequency band is between 4.5 kHz and 6 kHz.

4. The system of claim 1, wherein the listening space comprises a vehicle cabin.

5. The system of claim 4, wherein the coherence calculator receives the first microphone signal generated in response to the acoustic energy detected by the first microphone at a first location in the vehicle cabin, and receives the second microphone signal generated in response to the acoustic energy detected by the second microphone at a second location in the vehicle cabin.

6. The system of claim 1, wherein the system determines an amount of energy in the first and second microphone signals is attributable to the noise, and wherein a coherence corresponding to the at least one coherence value is related to an energy level of the first and second microphone signals.

7. The system of claim 1, further comprising a high frequency noise estimator that processes an output of the noise estimate computation processor to generate an adjustment value for adjusting the first and second audio signals to compensate for effects from the noise.

8. A noise compensation system, comprising:

a first input for receiving a first microphone signal;

a second input for receiving a second microphone signal, the first and second microphone signals generated from acoustic energy detected by the first and second microphones, wherein the acoustic energy represents a combination of an audio signal transduced by one or more speakers and environmental noise local to the first and second microphone signals;

a first coherence calculator that determines a first coherence value from a comparison of a first frequency band of a plurality of frequencies of the first and second microphone signals;

a second coherence calculator that determines a second coherence value from a comparison of a second frequency band of the plurality of frequencies of the first and second microphone signals; and a noise estimate computation processor that determines an estimate of a level of the noise in the acoustic energy based on an approximation according to the first and second coherence values and generates an adjustment value from the estimate that adjusts the audio signal.

9. The noise compensation system of claim 8, wherein the first and second frequency bands are centered at a frequency greater than 4 kHz.

10. The noise compensation system of claim 9, wherein the first and second frequency bands are located between frequencies ranging from 4.5 kHz and 6 kHz.

11. The noise compensation system of claim 8, wherein the noise level of the first and second microphone signals is derived from the environmental noise local to the first and second microphone signals, respectively.

12. The noise compensation system of claim 8, wherein the noise estimate computation processor includes a noise estimator that implements and executes one or more noise estimation schemes that are used in combination to derive an estimate of the noise based on an approximation according to the first and second coherence values.

13. A dynamic audio adjustment system, comprising:

a first filter that processes a first microphone signal input and outputs a predetermined range of frequencies of the first microphone signal input;

a second filter that processes a second microphone signal input and outputs a predetermined range of frequencies of the second microphone signal input, the first and second microphone signal inputs representing acoustic energy in a listening space that is sensed by a first microphone and a second microphone, respectively, the acoustic energy comprising a combination of an audio signal transduced by one or more speakers and noise within the listening space;

a first frequency analyzer that divides the predetermined range of frequencies of the first microphone signal input into a plurality of separate frequency bands, and outputs a frequency band value for each frequency band;

a second frequency analyzer that divides the predetermined range of frequencies of the second microphone signal input into a plurality of separate frequency bands, and outputs a frequency band value for each frequency band;

a coherence calculator for each frequency band, each coherence calculator determining a coherence value between frequency band values output from each of the first and second frequency analyzers; and a noise estimate computation processor that derives an estimate of a level of noise in the listening space based on an approximation according to the coherence values and generates an adjustment value from the estimate that adjusts the audio signal.

14. The dynamic audio adjustment system of claim 13, wherein the estimate of the noise level is determined in a high frequency band that is greater than 4 kHz.

15. The dynamic audio adjustment system of claim 13, wherein the high frequency band is between 4.5 kHz and 6 kHz.

16. The dynamic audio adjustment system of claim 13, wherein the noise estimate computation processor determines from the coherence values a coherence level relative to the microphone signals to derive the estimate of the level of noise.

17. The dynamic audio adjustment system of claim 13, wherein the first microphone is positioned at a first location in the listening space and the second microphone is positioned at a second location in the listening space for sensing the acoustic energy.

18. The dynamic audio adjustment system of claim 13, wherein the adjustment value is output for adjusting different electrical audio signals input to multiple speakers.

19. The dynamic audio adjustment system of claim 18, wherein the multiple speakers include a first speaker receiving left channel audio content and a second speaker receiving right channel audio content.

20. A method for sound adjustment/noise compensation comprising:

processing, by a special-purpose dynamic audio adjustment computer, a first microphone signal from a first microphone;

processing, by the special-purpose dynamic audio adjustment computer, a second microphone signal from a second microphone, the first and second microphone signals representing acoustic energy in a listening space that is sensed by the first microphone and the second microphone, respectively, the acoustic energy comprising a combination of an audio signal transduced by one or more speakers and noise within the listening space;

performing by the special-purpose dynamic audio adjustment computer an approximation based on a coherence level between the first and second microphone signals;

determining by the special-purpose dynamic audio adjustment computer an estimate of a level of the noise in the listening space based on the approximation according to coherence values corresponding to the coherence levels;

generating an adjustment value from the estimate; and adjusting the audio signal with the adjustment value.

21. A sound system, comprising:

a speaker that transduces an audio signal;

a first microphone and a second microphone that each senses acoustic energy comprising the transduced audio signal and environmental noise and generates a corresponding microphone signal; and a dynamic audio adjustment system that performs a coherence processing technique on the first and second microphone signals and generates an adjustment value that adjusts the audio signal in response to the coherence processing by determining an estimate of the environmental noise based on an approximation according to a result of the coherence processing.

22. The sound system of claim 21, wherein the dynamic audio adjustment system includes a noise estimator that implements and executes one or more noise estimation schemes that are used in combination to derive an estimate of a level of the environmental noise based on an approximation according to the coherence processing technique.

* * * * *